US012187518B1

(12) United States Patent
Kaminski

(10) Patent No.: US 12,187,518 B1
(45) Date of Patent: Jan. 7, 2025

(54) INFLATABLE PACKAGING VESSEL FOR FRAGILE ARTICLES

(71) Applicant: Michael G. Kaminski, Las Vegas, NV (US)

(72) Inventor: Michael G. Kaminski, Las Vegas, NV (US)

( * ) Notice: Subject to any disclaimer, the term of this patent is extended or adjusted under 35 U.S.C. 154(b) by 185 days.

(21) Appl. No.: 18/101,302

(22) Filed: Jan. 25, 2023

Related U.S. Application Data

(62) Division of application No. 17/541,173, filed on Dec. 2, 2021, now Pat. No. 11,591,152.

(60) Provisional application No. 63/120,222, filed on Dec. 2, 2020.

(51) Int. Cl.

| | |
|---|---|
| ***B65D 81/05*** | (2006.01) |
| ***B65B 5/02*** | (2006.01) |
| ***B65B 21/02*** | (2006.01) |

(52) U.S. Cl.
CPC ..... *B65D 81/052* (2013.01); *B65B 5/02* (2013.01); *B65B 21/02* (2013.01)

(58) Field of Classification Search
CPC ..... B65B 5/02; B65B 21/02; B65D 81/052
See application file for complete search history.

*Primary Examiner* — Daniel Jeremy Leeds
(74) *Attorney, Agent, or Firm* — Barry Choobin; Patent 360

(57) ABSTRACT

An inflatable packaging for storing multiple glass bottles made from a sheet that has a longitudinal axis and a traverse axis. The sheet is folded along six or more traverse fold lines spaced from each other to form a row of two or more pouches. The inflatable packaging can have two or more of such rows separated by a line of weakness. Each pouch has a front wall, a rear wall, a base, and an open-top for storing the glass bottle. Two adjacent pouches are separated by a dividing panel, wherein the dividing panel is corrugated in a biconcave shape.

16 Claims, 4 Drawing Sheets

INFLATABLE PACKAGING VESSEL FOR FRAGILE ARTICLES

CROSS-REFERENCE TO RELATED APPLICATIONS

This application is a Divisional of a U.S. patent application Ser. No. 17/541,173 filed on Feb. 12, 2021, which claims priority from a U.S. Provisional Patent Appl. No. 63/120,222 filed on Dec. 2, 2020, both of which are incorporated herein by reference in its entirety.

FIELD OF INVENTION

The present invention relates to inflatable packaging, and more particularly, the present invention relates to inflatable packing for storing and transporting multiple fragile articles, such as wine bottles.

BACKGROUND

The packaging is a means to protect an article from contamination, dirt, and damage. The packaging is of utmost significance in the manufacture, sale, and transport of articles. The primary purpose of the packaging is to protect an article from the environment. For example, packaging can protect an article from dust, water, etc. Also, the packaging has a primary function to protect an article from external shocks and bumps. This function of packaging is of importance in the transportation of fragile articles that are susceptible to damage during transportation. Good packaging can protect an article from damage due to shock or bumps both during transportation and mishandling of the article.

Multiple fragile containers, such as liquor bottles are generally stored and transported in cardboard boxes. Corrugated cardboard boxes are used for protection against bumps and shocks. Inside the box, the collision between the fragile containers is generally prevented by using crumpled paper or buffering material. However, the known method provided limited protection and the fragile container are susceptible to damage during the handling and transport of boxes. The buffering material between the bottles can get aggregated increasing the risk of collision of the bottles. The cardboard also provided limited cushioning against minor bumps and shocks.

Fragile containers or the contents of the fragile container can be costly. For example, most wines dispensed in glass bottles are costly and special care is taken in their handling. Trays are available to isolate the bottles in a box. However, the known method has several drawbacks, such as higher cost of transportation and storage of the bulky packaging articles, and increased cost of packaging per article. Moreover, transferring the bottles from the box can also be laborious and time-consuming.

Thus, a need is appreciated for an improved packaging for multiple fragile articles or containers that is devoid of the aforesaid drawbacks.

SUMMARY OF THE INVENTION

The principal objective of the present invention is therefore directed to an inflatable packaging for multiple fragile articles.

It is another object of the present invention that the inflatable packaging can be stored and transported flat to decrease the cost.

It is still another object of the present invention that the inflatable packaging provides both the isolation of fragile containers and protection against external bumps and shocks.

It is yet another object of the present invention that the inflatable packaging is economical to manufacture.

It is a further object of the present invention that the inflatable packaging permits the transfer of multiple fragile articles from the box at once.

It is an additional object of the present invention that the inflatable packaging allows safe storage and transportation of wine bottles.

It is still an additional object of the present invention that the inflatable packaging can completely cover wine bottles.

In one aspect, disclosed is an inflatable packaging for packing multiple fragile articles, such as wine bottles. The inflatable packaging can include a series of inflatable tubes of prolonged cylindrical configurations that are arranged side by side. Each inflatable tube can have an opening preferably at its end in fluid communication with a common air tube. One end of the common air tube is closed while the other end forms an inflation port. The opening of each inflatable tube can be provided with a check valve that allows air to be filled into the tube but prevents leakage of the air.

In one aspect, the inflatable packaging can include multiple units arranged in rows and columns, wherein each unit can receive a fragile article, such as a wine bottle. Each row can include two or more units and one or more of such rows can be provided in the disclosed inflatable packaging. Each unit has three panels forming two opposite upstanding walls and a base. Two units can be separated by a dividing panel.

In one aspect, a single sheet can be folded multiple times to form the row i.e., two or more units can be formed from a single sheet. The sheet can be formed by two plies bonded such as to form the inflatable tubes and the common air tube. Each inflatable tube can extend along the length of the sheet i.e., the row. The sheet can be folded along the length of the sheet to form the two or more units isolated by dividing panels. The sheet can be folded twice to form the two upstanding walls and a base of the unit. Another fold in the sheet can form the dividing panel. The left and right sides of the opposite walls of each unit can be bonded to form a pouch with an open-top for receiving an article for storage.

In one aspect, multiple rows can be manufactured from a single sheet, wherein a line of weakness can be provided to separate a row of units from the series of rows. The inflatable packaging having the series of rows can be provided as flattened and rolled, wherein the packaging of one or more rows can be separated from the series of rows. In one case, the series of rows can be inflated, and then the packaging of the desired number of rows can be separated from the series of rows. Alternatively, the separated packaging of one or more rows can be inflated.

In one aspect, the dividing panel between two units can be corrugated by soldering the points on the dividing panel in a round or biconvex pattern resulting in the biconcave two sides of the dividing panel adjacent to the two units. The biconcave sides of the dividing panel allow a cylindrical bottle to easily fit into the units and also maintain an inflated buffer between two units.

Each row can have or more units and one or more of such rows can be provided. Each unit has an upstanding wall having the inflatable tubes arranged longitudinally and side-by-side.

DETAILED DESCRIPTION

Disclosed is an inflatable packaging for fragile articles, such as glass wine bottles. Wine bottles having long necks require extreme care in transportation and multiple units of such bottles are packed and transported in boxes, such as carton boxes. The disclosed inflatable packaging can provide cushioned protection to the fragile article while storage and transportation. An additional advantage of the disclosed inflatable packaging is that the same can be shipped and stored in uninflated form taking less space and can be inflated just before packaging. Secondly, the disclosed inflatable packaging can be a single structure protecting multiple articles, therefore can be easily installed, and removed from the box.

The inflatable packaging can include two or more units wherein each unit can receive a single article, such as the wine bottle. The units can be provided in rows, wherein each row can have two or more units and inflatable packaging can have one or more of such rows. For example, three rows of two units each can be used for 6 bottle packaging. Each unit can include two opposite walls, a base, and an open-top forming a pouch into which the article can be placed.

Figure 1:
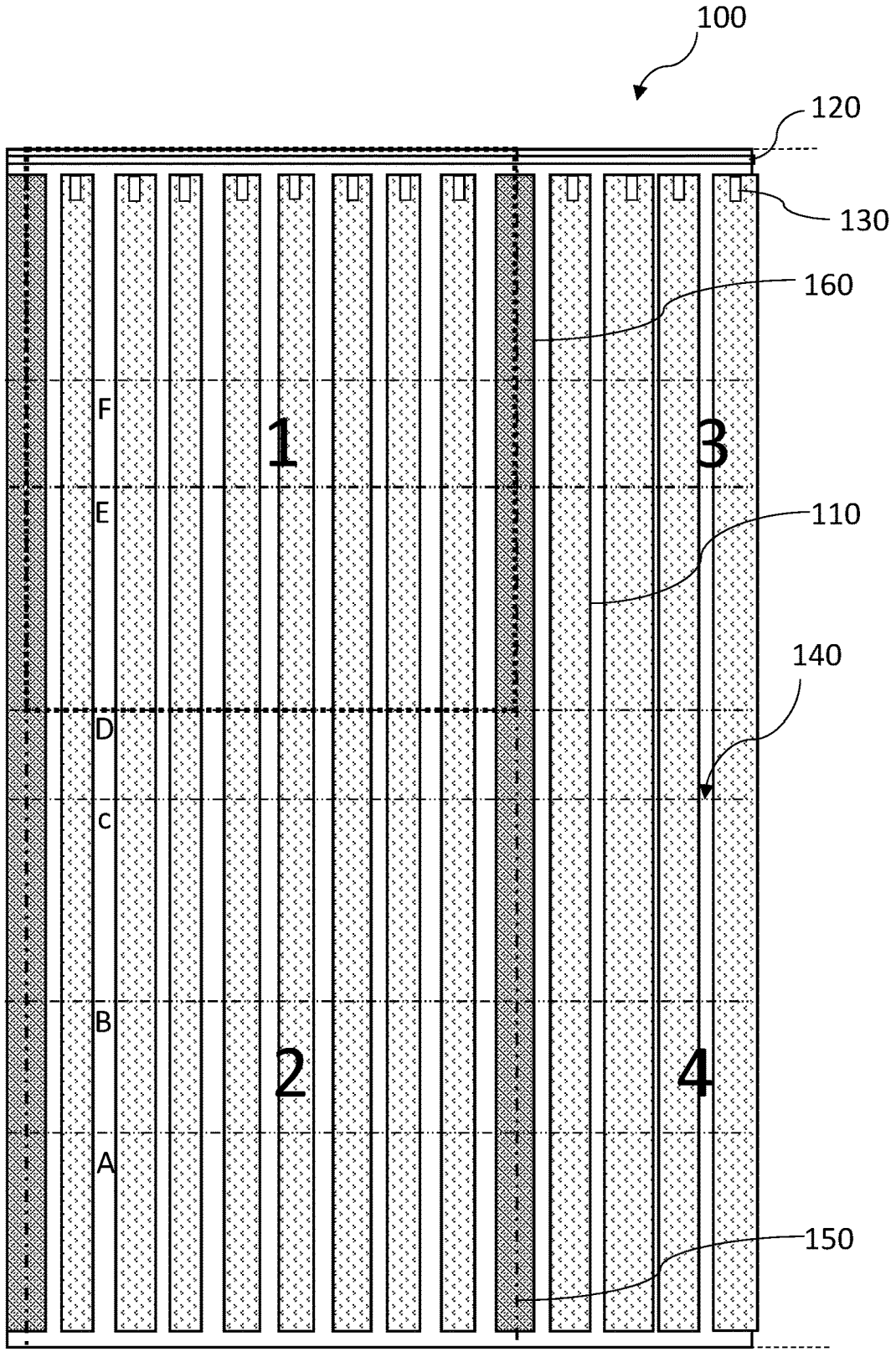
FIG. 1 is a planar schematic view of inflatable packaging shown unfolded that can be folded along the fold lines and soldered, also shown are inflatable tubes, soldering lines, and line of weakness, according to an exemplary embodiment of the present invention.

The inflatable packaging can be manufactured from a single sheet. Referring to FIG. 1, which shows a sheet 100 that can be used to produce the disclosed inflatable packaging. The sheet can be made by two plies that can be bonded in the predetermined pattern to form prolonged inflatable tubes and a common air tube. The inflatable tubes can extend along the length of the sheet, however, it is understood that more than one tube fluidly connected with each other can extend along the length of the sheet. The inflatable tubes can be arranged side-by-side parallel to each other along a width of the sheet. Each tube can have an opening at one end that can be fluidly coupled to the common air tube. Air can be filled in the inflatable tubes through the common air tube.

Referring to FIG. 1 which shows an exemplary embodiment of the inflatable packaging 100 for fragile articles, such as wine bottles. The inner inflatable liner includes a series of inflatable tubes 110 of prolonged cylindrical configurations that are arranged side by side. Each inflatable tube 110 is having an opening preferably at its end. Each inflatable tube is in fluid communication with a common air tube 120. One end of the common air tube is closed while the other end forms an inflation port. The inflation port can be an aperture or slit through which air under pressure can be drawn into the common air tube and from the common air tube into the inflatable tubes resulting in their inflation. It is understood that common air tube 120 can be replaced by any other structure known to a skilled person that may allow filling the air in the inflatable tubes 110 and any such structure of the common air tube 120 is within the scope of the present invention. The opening of the inflation tubes can be interrupted by a check valve 130. The check valve, also known as one-way valve, can be configured at the opening of the inflatable tubes to allow air to enter the inflatable tube 110 but does not allow the filled air from the inflatable tubes 110 to leak out through the opening. The use of a check valve 130 is advantageous in prolonging the life of the inflatable packaging 100 and limiting the spread of any damage to the functional portion of the packaging bag. This is because any leaked tube will not cause the deflation of the whole packaging. Thus, one or two damaged tubes will not make the inflatable packaging 100 ineffective. Moreover, the inflatable packaging 100 can be used again.

Continue referring to FIG. 1 a series of inflatable tubes 110 are arranged side-by-side and aligned with each other at their ends. The number of tubes and the length of the tubes can vary based on the size of the inflatable packaging 100 A larger sized article will require a bigger inflatable packaging 100 and thus a larger number of tubes. The length of the inflatable tubes 110 can be proportional to the length of the inflatable packaging 100. As can be seen in FIG. 1, the inflatable tubes 110 span across the length of the inflatable packaging 100 in fluid communication with common air tube 120 at one end of the inflatable tubes 110. However, it is understood that the single inflatable tube 110 can be substituted with more than one inflatable tube without departing from the scope of the present invention.

FIG. 1 shows the inflatable packaging 100 in the unfolded state for illustration and understanding of the invention. The inflatable packaging 100 can be folded at the fold lines 140 shown by dotted lines. The inflatable tubes 110 shown in FIG. 1 has two units "1" and "2" in a single row. Multiple such rows in the inflatable packaging 100 can be provided for the desired number of units. FIG. 1 also shows the second row having units "3" and "4". The rows can be separated from each other. A line of weakness 150 can be defined between the two rows along which a row can be separated from other rows. Perhaps, the inflatable packaging 100 can be provided as in an uninflated form having a series of rows packed in a roll or similar form. The inflatable packaging 100 of the desired number of rows can be torn from the roll of the series of rows.

The inflatable packaging 100 can be manufactured from a single sheet as shown in FIG. 1. Two plies can be bonded to form the sheet, wherein the inflatable tubes 110 and the common air tube 120 can be formed by the two plies. Line of weakness 150 can separate the rows of units, such as the inflatable packaging 100 of any number of rows can be separated by tearing along the line of weakness. Soldering layers can be provided at suitable places that allow the folded sheet to be bonded as explained below. Such soldering layer 160 is shown in FIG. 1 using darker shading. The soldering layer can be provided at suitable places that allow forming pouches by folding the sheet shown in FIG. 1

Figure 2:
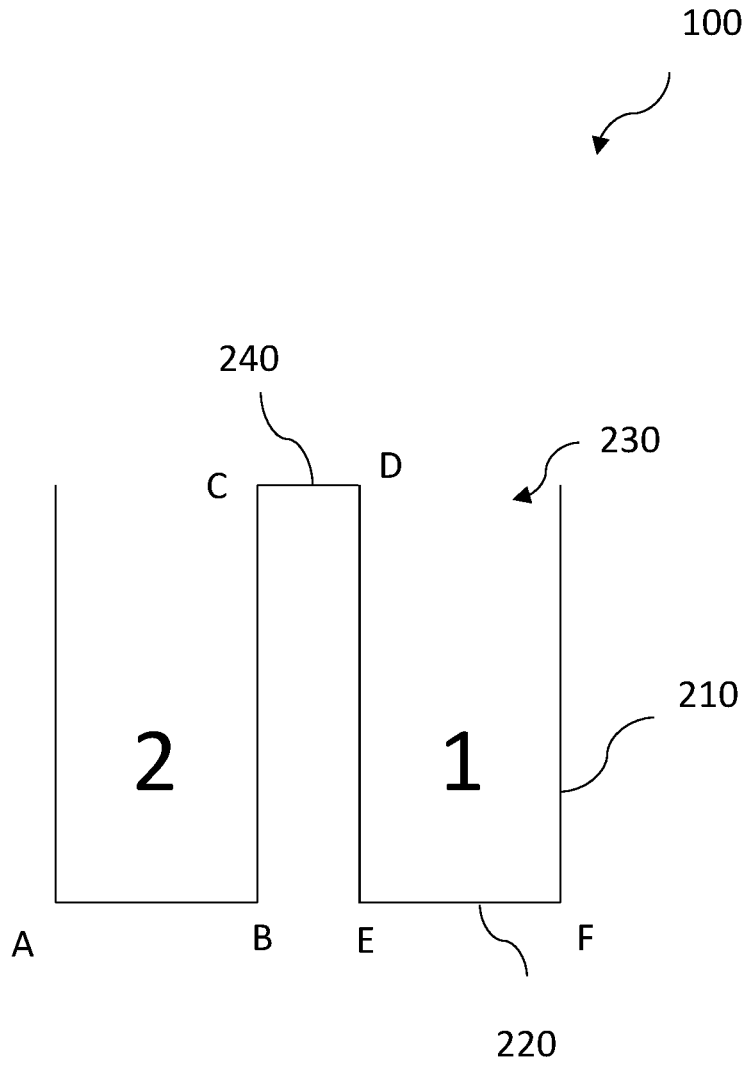
FIG. 2 is a schematic side view of the sheet arranged such as that show the folding pattern, according to an exemplary embodiment of the present invention.
Figure 3:
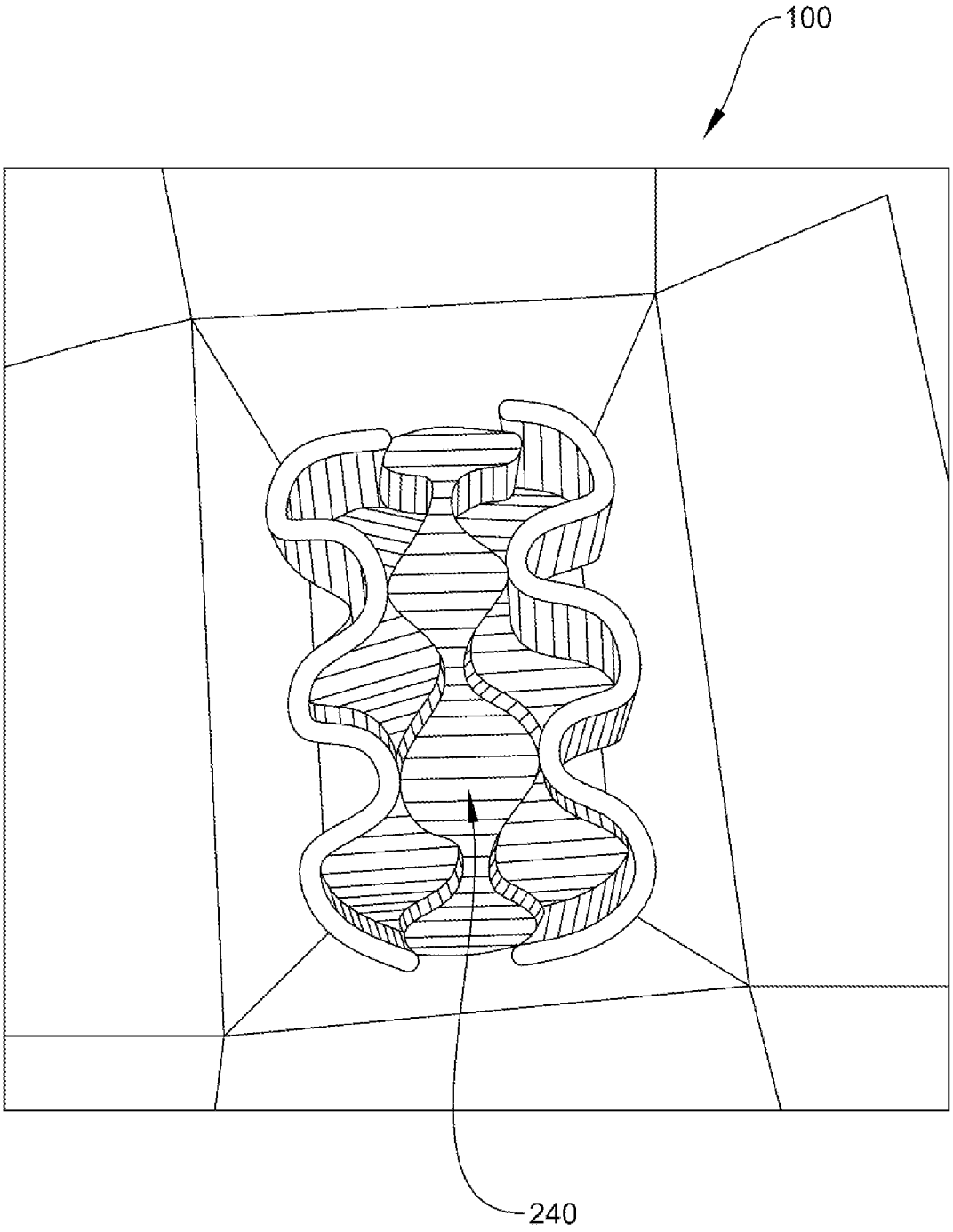
FIG. 3 shows the inflatable packaging having three rows of two units each and the inflatable packaging is shown inflated, according to an exemplary embodiment of the present invention.

The panes of the sheet shown in FIG. 1 can be folded along the fold lines 140. FIG. 2 shows such a pattern for folding the sheet. First, two folds along the fold line "A" and "B" in the sheet shown in FIG. 1 forms the second unit "2" that two upstanding walls 210 a base 220, and an open-top 230. Side edges along the opposite walls 210 and the base 220 can be soldered to form a pouch having an open-top 230. The article to be stored can be placed in the pouch through the open-top. The sheet can again be folded at fold line "C" and then at fold line "D" to form dividing panel 240. This dividing panel can provide a cushioning buffer between two adjacent units i.e., units "1" and "2" in FIG. 2. The sheet can be continuing to be folded at the fold lines "E" and "F" to form the second unit "1". The row can have more than two units and for more than two units, a longer sheet can be provided and folded as above to form the additional unit. FIG. 3 shows an exemplary embodiment of the inflatable packaging 100 that includes three rows, and each row has two units. The inflatable packaging 100 in FIG. 3 is shown inflated and disposed in a box. In FIG. 3, the dividing panel 240 can be seen shrink in the middle of two units forming a substantially a cylindrical shape pouch or unit. The dividing panel 240 can be made shrink in the middle to increase the capacity of the unit and to easily receive a cylindrical object, such as a wine bottle.

Figure 4:
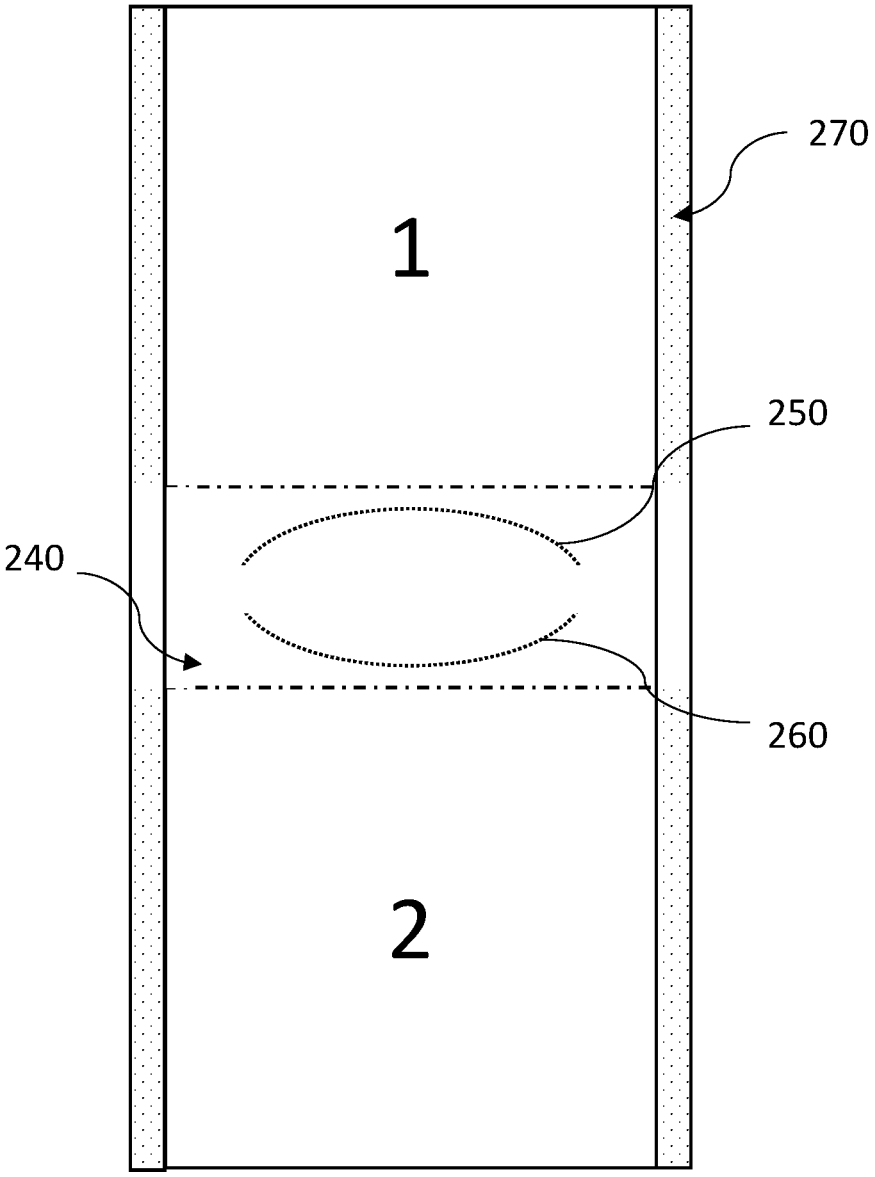
FIG. 4 shows the elliptical arrangement of points on a dividing panel that can be bonded to shrink the dividing panel between mid of the two units in a row, according to an exemplary embodiment of the present invention.

The rectangular or square shape dividing panel shown in FIG. 2 can be made shrink by soldering at suitable points. FIG. 4 shows the single row having the two unit "1" and "2" and the dividing panel 240 between the two units. The dividing panel can be corrugated by soldering points in the biconvex or round pattern as shown in the diving panel 240 in FIG. 4 by two dotted curved arcs. The points on the dividing panel along first arc 250 can be soldered at points along the arc 260 resulting in a biconcave shape dividing panel as shown in FIG. 3. FIG. 4 also shows the soldering layers 270 alongside edges of the units "1" and "2" illustrated by a dotted pattern. It is to be understood that the soldering area on the dividing panel can be provided on either side of the sheet i.e., without departing from the scope of the present invention. Additionally, FIG. 4 shows the soldering layer 270 alongside edges of the units only, however, the whole soldering layer can be provided continuously along the length of the sheet.

The inflatable packaging 100 folded and soldered at side edges to form pouches and the corrugated dividing panel can be provided in an uninflated form. Such inflatable packaging 100 can include one or more rows separated by the line of weakness. The folded and soldered inflatable packaging 100 can be provided as a roll or similar arrangement for easy transportation and storage. The inflatable packaging 100 having the desired number of rows can be separated from the roll.

The disclosed inflatable packaging can be used to protect neck glass bottles of different sizes and different sizes of the neck. Single packaging can be manufactured for storing several bottles isolated from each other. Preferably, the packaging can be manufactured for 3, 6, and 12 bottles packaging. For example, large size three bottles can be packed together. Medium size bottles of capacities ranging from 600 ml to 1500 ml can be packed in 6 units. Smaller bottles can have a packaging of 12 units. The disclosed inflatable packaging can be made from polymeric materials. Additional additives can be added to enhance the properties of the polymers, such as biodegradable, colors, sparkles, and the like.

For complete protection of the articles, such as wine bottles, the inflatable packaging shown in FIG. 3 can cover more than half of the bottle and another similar inflatable packaging can be mounted at the top to completely cover and protect each bottle. Additionally, in a row of inflatable packaging having only two units, the bottle can be put into one unit while the other unit can fold over the top of the bottle.

each chamber affords a sealed island within the chambers of all subsequent chambers, allowing for a (multiple) gusted bending point in which the internal shipping vessel can be manipulated to minimize overall cubic size. Said gusset(s) would be symmetrical and in a repeating pattern to adjacent chambers.

What is claimed is:

1. A method for packing a plurality of articles, the method comprising the steps of:

providing an inflatable packaging, the inflatable packaging comprises:

a sheet that has a longitudinal axis and a traverse axis, the sheet has a proximal edge and a distal edge, the longitudinal axis extends between the proximal edge and the distal edge, a plurality of inflatable bars extend along the longitudinal axis of the sheet, the sheet folded along six or more fold lines to form at least one row, the six or more fold lines are parallel to each other and parallel to the traverse axis, each row of the at least one row has at least two pouches, each pouch of the at least two pouches has a front wall, a rear wall, a base, and an open-top, left and right edges of the front wall and the rear wall of the each pouch are bonded, wherein the front wall and the rear wall of each pouch are spaced apart and define an inner volume of the pouch, the inner volume of each pouch is configured to receive an article, two adjacent pouches in a row of the at least one row are separated by a dividing panel.

2. The method according to claim 1, wherein the inflatable packaging further comprises:

a common air tube that extends along the traverse axis, each of the plurality of inflatable bars is in fluid communication with the common air tube.

3. The method according to claim 2, wherein each inflatable bar of the plurality of inflatable bars has an opening in fluid communication with the common air tube, wherein the opening is interrupted by a one-way valve, such that air from the common air tube fills into the inflatable bar, air from the inflatable bar cannot leak into the common air tube.

4. The method according to claim 1, wherein the at least one row comprises a series of rows, wherein two adjacent rows in the series of rows are divided by a line of weakness.

5. The method according to claim 1, wherein the six or more-fold lines comprise six consecutive fold lines spaced apart from each other by predetermined distances, wherein:

a front wall of a first pouch in a first row of the at least one row extends between the proximal edge and a first fold line, a base of the first pouch extends between the first fold line and a second fold line, a rear wall of the first pouch extends between the second fold line and a third fold line, a first dividing panel extends between the third fold line and a fourth fold line, a front wall of a second pouch of the first row extends between the fourth fold line and a fifth fold line, a base of the second pouch extends between the fifth fold line and a sixth fold line, and a rear wall of the second pouch extends between the sixth fold line and the distal edge.

6. The method according to claim 5, wherein the inflatable packaging further comprises:

a second row, the second row has a third pouch and a fourth pouch, a line of weakness divides the first row and the second row, such that the first row can be torn from the second row along the line of weakness.

7. The method according to claim 5, wherein the dividing panel is corrugated in a biconcave pattern, wherein the first pouch and the second pouch have round or elliptical shaped open-top.

8. The method according to claim 7, wherein the plurality of inflatable bars extends from the front wall of the first pouch to the rear wall of the second pouch.

9. The method according to claim 1, wherein the dividing panel is corrugated in a biconcave pattern such that the at least two pouches have a round or elliptical shaped open-top.

10. The method according to claim 1, wherein the plurality of articles are glass bottles.

11. The method according to claim 1, wherein the dividing panel comprises:

a series of soldering points arranged along two curved arches forming a biconvex pattern on a top face of the dividing panel, the two curved arches have a first arch and a second arch, wherein the soldering points along the first arch are configured to be soldered to the corresponding soldering points along the second arch.

12. A method of manufacturing an inflatable packaging, the method comprising the steps of:

providing a sheet that has a longitudinal axis and a traverse axis, the sheet has a proximal edge and a distal edge, the longitudinal axis extends between the proximal edge and the distal edge, a plurality of inflatable bars extends side-by-side along the longitudinal axis of the sheet;

folding the sheet in a pre-determined pattern along six or more fold lines to form at least one row, the six or more fold lines are parallel to each other and parallel to the traverse axis, each row of the at least one row has at least two pouches, each pouch of the at least two pouches has a front wall, a rear wall, a base, and an open-top;

bonding left and right edges of the front wall and the rear wall of the each pouch, wherein the front wall and the rear wall of each pouch are spaced apart and define an inner volume of the pouch, the inner volume of each pouch is configured to receive an article, wherein two adjacent pouches in a row of the at least one row are separated by a dividing panel.

13. The method according to claim 12, wherein the method further comprises the steps of:

corrugating the dividing panel to a biconcave shape.

14. The method according to claim 13, wherein the sheet is formed by two plies bonded to each other such that to form a plurality of inflatable bars that extends along the longitudinal axis and arranged side-by-side along the transverse axis.

15. The method according to claim 13, wherein method further comprises the step of:

making a line of weakness between two adjacent rows of the at least one row.

16. The method according to claim 13, wherein the sheet is folded along six fold lines to form two pouches i.e., a first pouch and a second pouch, a front wall of the first pouch extends between the proximal edge and a first fold line, a base of the first pouch extends between the first fold line and a second fold line, a rear wall of the first pouch extends between the second fold line and a third fold line, the dividing panel extends between the third fold line and a fourth fold line, a front wall of the second pouch extends between the fourth fold line and a fifth fold line, a base of the second pouch extends between the fifth fold line and a sixth fold line, and a rear wall of the second pouch extends between the sixth fold line and the distal edge.

* * * * *